US006568953B1

(12) United States Patent
AbuGhazaleh et al.

(10) Patent No.: US 6,568,953 B1
(45) Date of Patent: May 27, 2003

(54) ELECTRICAL CONNECTOR WITH OVERTWISTED WIRE PAIRS

(75) Inventors: Shadi A. AbuGhazaleh, Gales Ferry, CT (US); Rance S. Rust, Waterford, CT (US); Rehan Mahmood, Ashaway, RI (US); Stanley Schultz, Norwich, CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 10/060,098

(22) Filed: Jan. 31, 2002

(51) Int. Cl.[7] ..... H01R 4/24
(52) U.S. Cl. ..... 439/418; 439/676
(58) Field of Search ..... 439/418, 417, 439/344, 676, 941

(56) References Cited

U.S. PATENT DOCUMENTS

| | | | | |
|---|---|---|---|---|
| 5,226,835 A | | 7/1993 | Baker, III et al. | 439/403 |
| 5,350,324 A | | 9/1994 | Guilbert | 439/894 |
| 5,911,594 A | | 6/1999 | Baker, III et al. | 439/404 |
| 6,007,368 A | | 12/1999 | Lorenz et al. | 439/418 |
| 6,123,572 A | * | 9/2000 | Ishii et al. | 439/465 |
| 6,176,732 B1 | | 1/2001 | Schultz et al. | 439/404 |
| 6,250,951 B1 | * | 6/2001 | Milner et al. | 439/640 |
| 6,319,048 B1 | * | 11/2001 | Aekins et al. | 439/418 |
| 6,431,904 B1 | * | 8/2002 | Berelsman | 439/447 |
| 6,439,911 B1 | * | 8/2002 | Conorich | 439/341 |
| 6,439,920 B1 | * | 8/2002 | Chen | 439/418 |
| 2001/0053627 A1 | * | 12/2001 | Armistead et al. | 439/502 |
| 2002/0048990 A1 | * | 4/2002 | Marowsky et al. | 439/418 |

FOREIGN PATENT DOCUMENTS

| | | |
|---|---|---|
| JP | 07169526 | 7/1995 |

* cited by examiner

*Primary Examiner*—P. Austin Bradley
*Assistant Examiner*—Ross Gushi
(74) *Attorney, Agent, or Firm*—Mark S. Bicks; Alfred N. Goodman; Tara L. Hoffman

(57) ABSTRACT

An electrical connector includes a dielectric body having an input end and an output end opposite the input end. First and second electrical contacts are located at the output end. A twisted wire pair is connected to the first and second electrical contacts, defines an axial length, includes first and second wires twisted along the axial length, and has first and second terminal ends. The first and second terminal ends are connected to the first and second electrical contacts and include first and second portions. The first portion is located axially between the second portion and first and second terminal ends of the first and second wires. The first portion has a first degree of twist about a longitudinal axis of the twisted wire pair. The second portion has a second degree of twist about the longitudinal axis of the twisted wire pair. The first degree of twist is substantially greater than the second degree of twist.

20 Claims, 1 Drawing Sheet

ELECTRICAL CONNECTOR WITH OVERTWISTED WIRE PAIRS

FIELD OF THE INVENTION

The present invention relates to an electrical connector that meets high performance standards particularly in high speed data transmissions. More specifically, the present invention relates to an electrical connector, such as a telecommunications plug, receivable in a another mating connector, such as a telecommunications jack, that includes overtwisted wire pairs in the connector to reduce crosstalk, thereby increasing performance to meet high performance standards, such as in category 6 applications.

BACKGROUND OF THE INVENTION

Advancements in telecommunications require high speed data transmission. In order to meet performance standards for high speed data transmission, such as category 6 performance standards, crosstalk must be reduced. Conventional electrical connectors, such as telecommunication plugs and jacks, produce unacceptable levels of crosstalk due to interfering signals from the wires of the connectors, thereby degrading the performance of the connector. In particular, conventional plugs, such as the industry standard RJ45 plug, terminate cables typically having eight wires that are close together and parallel leading to excessive crosstalk.

A conventional solution to this crosstalk problem is to twist each pair of wires. Specifically, when wires of a pair are twisted their equal and opposite signals cancel each other resulting in a reduction of crosstalk between the wires. However, this solution is often inadequate for high speed data transmissions, particularly due the need to untwist or separate the wires in order to connect them to pins corresponding to their terminal assignments. Specifically, the distance from where the wires are separated to the pins significantly contributes to crosstalk. Additionally, air or space between individual wires of a wire pair also affects impedance which can increases return loss or signal reflection as the signals travel through the connector, thereby decreasing performance.

Another solution to the problem of crosstalk, is to provide a dielectric insert or block where the wires are separated in the connector, thereby fixing the positions of each wire pair and reducing crosstalk by isolating the signals of the wires from each other. Although this solution reduces crosstalk, incorporation of such inserts is cost prohibitive.

Examples of conventional telecommunications electrical connectors include U.S. Pat. No. 6,007,368 to Lorenz et al; U.S. Pat. No. 5,350,324 to Guilbert; U.S. Pat. No. 5,911,594 to Baker, III et al.; U.S. Pat. No. 6,176,732 to Schultz et al.; and U.S. Pat. No. 5,226,835 to Baker, III, the subject matter of each of which is herein incorporated by reference.

SUMMARY OF THE INVENTION

Accordingly, an object of the present invention is to provide an electrical connector that reduces crosstalk and improves performance, particularly in category 6 applications.

Another object of the present invention is to provide an electrical connector that is inexpensive to manufacture and also meets performance standards for high speed data transmissions.

Yet another object of the present invention is to provide an electrical connector that includes overtwisted wire pairs to reduce crosstalk and also increase the stability of the wire pairs.

The foregoing objects are basically attained by an electrical connector including a dielectric body that has an input end and an output end opposite the input end. First and second electrical contacts are located at the output end. A twisted wire pair is connected to the first and second electrical contacts. The twisted wire pair defines an axial length includes first and second wires twisted along the axial length, and has first and second terminal ends, respectively. The first and second terminal ends are connected to the first and second electrical contacts, respectively, and include first and second portions. The first portion is located axially between the second portion and first and second terminal ends of the first and second wires. The first portion having a first degree of twist about a longitudinal axis of the twisted wire pair. The second portion has a second degree of twist about the longitudinal axis of the twisted wire pair. The first degree of twist is substantially greater than the second degree of twist.

The foregoing objects are also attained by a method of terminating wires to an electrical connector, comprising the step of twisting together first and second wires to a form a first twisted wire pair having an axial length and first and second portions,. The first portion is located axially between the second portion and the terminal ends of the first and second wires. The method also includes the step of overtwisting the first portion of the first twisted wire pair about the axial length so that the degree of twist about the axial length at the first portion is substantially greater that the degree of twist about the axial length at the second portion. Also, the method includes the step of connecting the first and second terminal ends of the first and second wires, respectively, to first and second electrical contacts, respectively, of the electrical connector.

By forming the electrical connector in the above manner, crosstalk is reduce and performance is enhanced to meet the requirements of high speed data transmissions without the use of an insert.

Other objects, advantages and salient features of the invention will become apparent from the following detailed description, which, taken in conjunction with annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
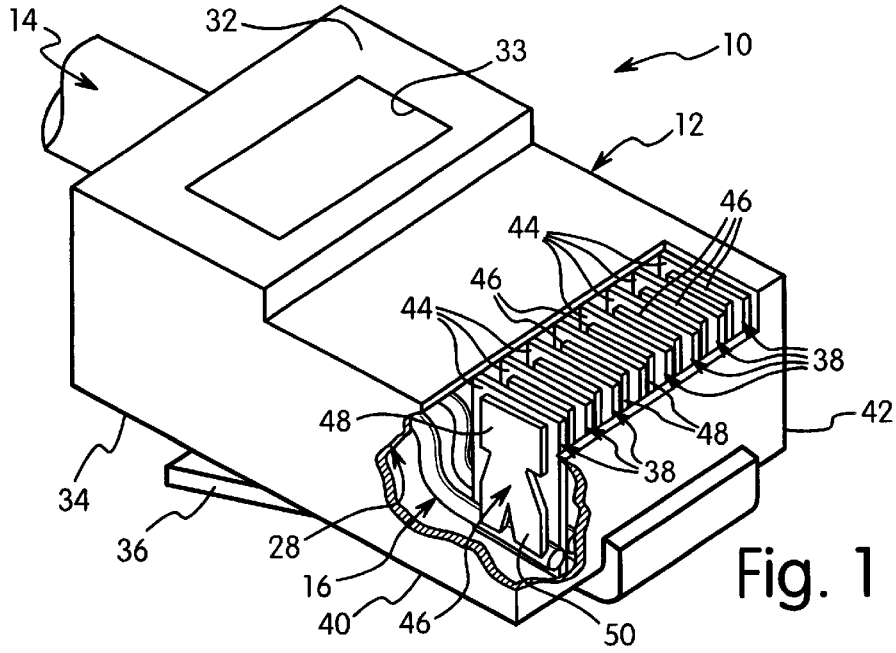
FIG. 1 is a partial perspective view of an electrical connector in accordance with an embodiment of the present invention, showing a wire connected to an electrical contact of the connector.
Figure 2:
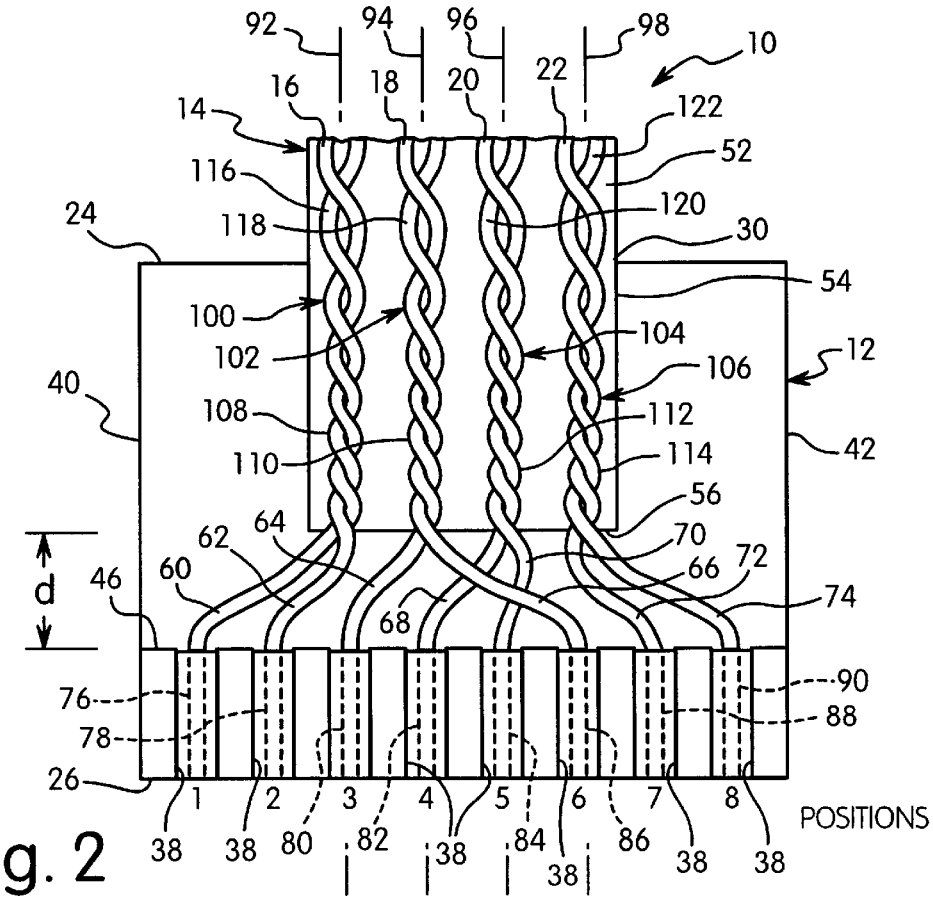
FIG. 2 is a diagrammatic top plan view of the electrical connector illustrated in FIG. 1, showing the overtwisted wire pairs connected to their respective terminal assignments.

Referring to FIGS. 1 and 2, an electrical connector 10 in accordance with an embodiment of the present invention generally includes a dielectric body 12 that receives a cable 14 having first, second, third, and fourth twisted wires pairs 16, 18, 20 and 22. First, second, third, and fourth twisted wires pairs 16, 18, 20 and 22 are overtwisted to reduce crosstalk and improve performance required for high speed telecommunications data transmission, such as for category 6 applications. Electrical connector 10 is preferably a telecommunications plug that is connectable to a mating connector (not shown), such as a category 6 jack.

As seen in FIG. 1, the structure of electrical connector 10 is that of a conventional RJ45 plug connector including dielectric body 12 with an input end 24 for receiving cable 14 and an output end 26 receivable in a mating connector for electrical connection therewith. Dielectric body 12 includes an inner cavity 28 for receiving and supporting cable 14 with an access opening 30 provided in input end 24. The top wall 32 of connector 10 includes an opening 33 near input end 24 shaped to receive a strain relief member (not shown) for crimping cable 14 when received in body inner cavity 28 in a conventional manner. The bottom wall 34 of connector 10 includes a conventional spring lock tab 36 for securing connector 10 to a mating connector.

At output end 26 of connector body 12 are an array of terminal slots 38 extending from a first side wall 40 to an opposite second side wall 42. Each slot 38 is open at its upper end 44 and receives an electrical contact 46. As seen in FIGS. 1 and 2, electrical contacts 46 represent terminal positions 1–8, respectively, standard in telecommunications connectors. Each electrical contact 46 is preferably a conventional metallic pin having a contact end 48 and insulation displacement end 50 opposite contact end 48, as seen in FIG. 1. Each contact end 48 is exposed at the upper ends 44 of terminal slots 38 for electrical connection with the contacts (not shown) of the mating connector. Each insulation displacement end 50 tears or pierces first, second, third, and fourth wire pairs 16, 18, 20 and 22, respectively, for mechanically and electrical connection thereto, as is well known in the art.

As seen in FIGS. 1 and 2, cable 14 includes a cable body 52 supporting first, second, third, and fourth wire pairs 16, 18, 20 and 22 within a cable jacket 54 with the wire pairs extending through and beyond the cable open end 56. Cable 14 extends through access opening 30 of electrical connector 10 and into connector inner cavity 28 with the cable body 52 being crimped at connector input end 24, as is well known in the art.

Cable 14 supports first, second, third, and fourth wire pairs 16, 18, 20 and 22. Each wire pair 16, 18, 20 and 22 includes two wires twisted around each other along a longitudinal axis. Wire pairs 16, 18, 20 and 22 are shown spaced from one another for illustrative purposes, however, in use these wire pairs are adjacent or overlap one another. In particular, first twisted wire pair 16 includes twisted first and second wires 60 and 62, second wire pair 18 includes twisted third and fourth wires 64 and 66, third wire pair includes twisted fifth and sixth wires 68 and 70, and fourth wire pair includes twisted seventh and eight wires 72 and 74. As seen in FIG. 2, first and second wires 60 and 62 are connectable to electrical contacts 46 at terminal positions 1 and 2, respectively, by wire terminal ends 76 and 78; third and fourth wires 64 and 66 are connectable to electrical contacts 46 at terminal positions 4 and 5, respectively, by wire terminal ends 80 and 82; fifth and sixth wires 68 and 70 are connectable to electrical contacts 46 at terminals positions 3 and 6, respectively, by wire terminal ends 84 and 86; and seventh and eighth wires 72 and 74 are connectable to electrical contacts 46 at terminal positions 7 and 8, respectively, by wire terminal ends 88 and 90.

Each wire pair 16, 18, 20 and 22 defines a longitudinal axis 92, 94, 96 and 98, respectively, and an axial length 100, 102, 104, and 106, respectively. Wires 60 and 62 of first wire pair 16 are twisted about longitudinal axis 92 and along axial length 100. Similarly, wires 64 and 66 of second wire pair 18 are twisted about longitudinal axis 94 and along axial length 102. Likewise, wires 68 and 70 of third wire pair 20 are twisted about longitudinal axis 96 and along axial length 104. Also, wires 72 and 74 of fourth wire pair 22 are twisted about longitudinal axis 98 and along axial length 106.

Each wire pair 16, 18, 20 and 22 also defines first portions 108, 110, 112 and 114, respectively, near cable open end 56 and second portions 116, 118, 120 and 122, respectively, at cable body 52, as seen in FIG. 2. Each first portion 108, 110, 112 and 114 is located axially between respective wire terminal ends 76, 78, 80, 82, 84, 86, 88 and 90 and each respective second portion 116, 118, 120 and 122. Each first portion 108, 110, 112 and 114 is overtwisted along the entire length of each first portion, as seen in FIG. 2, to reduce crosstalk and increase performance of connector 10 and mechanically strengthen wire pairs 16, 18, 20 and 22. In particular, first portions 108, 110, 112 and 114 are overtwisted with a first degree of twist about respective longitudinal axes 92, 94, 96 and 98 of wire pairs 16, 18, 20 and 22. The first degree of twist of wire pair first portions 108, 110, 112 and 114 is preferably about 360 degrees to 980 degrees about respective longitudinal axes 92, 94, 96 and 98 for the length of each respective first portion 108, 110, 112 and 114. The optimum first degree of twist is about 720 degrees along the respective lengths of each of the first portions which is within 8.0 to 10 mm of the terminal ends. The first degree of twist of first portions 108, 110, 112 and 114 is preferably substantially greater than a second degree of twist at second portions 116, 118, 120 and 122. The second degree of twist is about 360 degrees about respective longitudinal axes 92, 94, 96 and 98 of wire pairs 16, 18, 20 and 22. Preferably, the first degree of twist is about twice the second degree of twist.

The degree of twist is the number of rotations or degrees of rotation the wire makes about the longitudinal axis per unit length along the longitudinal axis.

Assembly of electrical connector 10 includes preparing cable 14 for insertion into connector body 12 by initially overtwisting first portions 108, 110, 112 and 114 of respective wire pairs 16, 18, 20, and 22. The cable jacket 54 surrounds first portions 108, 110, 112 and 114 with wire terminal ends 76, 78, 80, 82, 84, 86, 88 and 90 extending though and beyond cable open end 56. Overtwisting the wire pairs 16, 18, 20, and 22 helps to maintain the wire pairs 16, 18, 20, and 22 in a twisted state.

Cable 14 can then be inserted through access opening 30, into connector body inner cavity 28 and crimped in a conventional manner. The overtwisting of wire pairs 16, 18, 20, and 22 provides stability and rigidity to the wire pairs, particularly during crimping thereof by the connector strain relief Once cable 14 is secured within electrical connector 10, the wire pairs and their terminal ends are connected to their respective terminal positions or assignments 1 through 8. In particular, wire pair 16 is attached to terminal positions 1 and 2, wire pair 18 is attached to terminal positions 4 and 5, wire pair 20 is attached to terminal positions 3 and 6, and wire pair 20 is attached to terminal positions 7 and 8. For example, terminal ends 76 and 78 of wires 60 and 62, respectively, of wire pair 16 are connected to pins 46 at terminals 1 and 2, respectively, via insulation displacement ends 50 of pins 46. The signals of wires 60 and 62 are cancelled due to the twisting of the two wires 60 and 62. Since the wire pair 16 is overtwisted at first portion 108, any spaced between the wires 60 and 62 are eliminated and the wire pair 16 is made more compact. The compactness and elimination of spaces between the individual wires 60 and 62 of wire pairs 16 ensures less return loss or reflective signal thus increasing performance of the connector, particularly in high speed data transmissions. The remaining wire pairs 18, 20 and 22 and their respective wires 64, 66, 68, 70, 72 and 74 are connected to electrical contacts 46 in a similar manner and operate in a similar fashion.

Additionally, the overtwist of wire pairs 16, 18, 20 and 22 maintains the twist between the individual wires of each wire pair to within close proximity of electrical contacts 46, thereby reducing the separation distance of the individual wires. For example, the twist of wires 60 and 62 of wire pair 18 is maintained until separated for connection to electrical contacts 46 at terminal positions 1 and 2. The distance d, as seen in FIG. 2, defined between the point offirst separation of wires 60 and 62 and the point of connection of wires 60 and 62 with electrical connectors 46 is minimized to reduce the separation of wires 60 and 62. By minimizing the distance d or separation of wires 60 and 62 and maintaining the twist of wires 60 and 62 up to the open end 56 of cable 14, the signals of wires 60 and 62 cancel each other more effectively, thereby reducing crosstalk. This distance d is also minimized for the remaining wire pairs 18, 20 and 22 and their respective wires 64, 66, 68, 70, 72 and 74 in the same manner. Preferably, the overtwist of wire pairs 16, 18, 20 and 22 is maintained to within about 8–10 mm of electrical contacts 46.

Once wire pairs 16, 18, 20 and 22 are properly connected to their respective electrical contacts 46, electrical connector is connectable with a mating connector adapted to receive output end 26 of connector 10. Spring lock tab 36 secures connector 10 within the mating connector.

While a particular embodiment has been chosen to illustrate the invention, it will be understood by those skilled in the art that various changes and modifications can be made therein without departing from the scope of the invention as defined in the appended claims.

What is claimed is:

1. An electrical connector, comprising:

a dielectric body having an input end and an output end opposite said input end;

first and second electrical contacts located at said output end;

a twisted wire pair connected to said first and second electrical contacts, said twisted wire pair defining an axial length and including first and second wires twisted along said axial length and having first and second terminal ends, respectively, said first and second terminal ends being connected to said first and second electrical contacts, respectively, and said twisted wire pair including first and second portions with said first portion being located axially between said second portion and said terminal ends of said first and second wires, said first portion having a first degree of twist about a longitudinal axis of said twisted wire pair, and said second portion having a second degree of twist about said longitudinal axis of said twisted wire pair, said first degree of twist being substantially greater than said second degree of twist.

2. An electrical connector according to claim 1, wherein said first portion of said twisted wire pair is located near said electrical contacts.

3. An electrical connector according to claim 1, wherein said output end of said dielectric body is connectable to a mating connector.

4. An electrical connector according to claim 1, wherein said first degree of twist of said first portion is about 360 degrees to 980 degrees.

5. An electrical connector according to claim 4, wherein said first degree of twist is about 720 degrees.

6. An electrical connector according to claim 1, wherein said first and second electrical contacts include insulation displacing ends, respectively, for connection to said first and second wires.

7. An electrical connector according to claim 6, wherein said dielectric body includes an aperture with an access opening at said input end; and said first twisted wire pair is received in said aperture through said access opening.

8. An electrical connector, comprising a dielectric body having an input end and an output end opposite said input end and a plurality of electrical contacts located at said output end;

a cable extending into said input end, said cable including a plurality of twisted wire pairs for connection to said electrical contacts, each of said twisted wire pairs including, an axial length, first and second wires twisted along said axial length, said first and second wires having terminal ends, respectively, each of said terminal ends being connected to one of said electrical contacts, and each of said twisted wire pairs defining first and second portions with said first portion being located axially between said second portion and said electrical contacts, each of said first portions having a first degree of twist about a longitudinal axis of each of said twisted wire pairs, respectively, and each of said second portions having a second degree of twist about each of said longitudinal axes of each said twisted wire pairs, respectively, and said first degree of twist being substantially greater than said second degree of twist.

9. An electrical connector according to claim 8, wherein said output end being adapted for connection with a mating connector.

10. An electrical connector according to claim 8, wherein said first degree of twist of each of said first portions of said twisted wire pairs is about 360 degrees to 980 degrees.

11. An electrical connector according to claim 10, wherein said first degree of twist is about 720 degrees.

12. An electrical connector according to claim 8, wherein said first portions of each of said twisted wire pairs are located near said electrical contacts.

13. An electrical connector according to claim 12, wherein said first portions of each of said twisted wire pairs are located less than 10 mm from said electrical contacts.

14. A met hod of terminating wires to an electrical connector, comprising the steps of:

twisting together first and second wires to a form a first twisted wire pair having a longitudinal axis and first and second portions, with the first portion being axially between the second portion and terminal ends of the first and second wires;

overtwisting the first portion of the first twisted wire pair about the longitudinal axis so that the degree of twist about the longitudinal axis at the first portion is substantially greater that the degree of twist about the longitudinal axis at the second portion; and connecting the terminal ends of the first and second wires to first and second electrical contacts, respectively, of the electrical connector.

15. A method in accordance with claim 14, further comprising the step of inserting the first twisted wire pair into a dielectric body of the electrical connector after overtwisting the first portion of the first wire pair.

16. A method in accordance with claim 14, further comprising the step of connecting an output end of the electrical connector with a mating connector after connecting the first and second wires with the first and second electrical connectors, respectively, the first and second electrical contacts being located at the output end.

17. A method in accordance with claim 14, wherein the overtwisted first portion of the first twisted wire pair is located near the first and second electrical contacts once the first and second wires are connected to the first and second electrical contacts, respectively.

18. A method in accordance with claim 17, wherein the overtwisted first portion is located a distance of less than 10 mm from the first and second electrical contacts.

19. A method in accordance with claim 14, further comprising the steps of twisting together third and fourth wires to a form a second twisted wire pair having a longitudinal axis and first and second portions, with the first portion being axially between the second portion and terminal ends of the third and fourth wires;

overtwisting the first portion of the second twisted wire pair about the longitudinal axis so that the degree of twist about the longitudinal axis at the first portion is substantially greater that the degree of twist about the longitudinal axis at the second portion; and connecting the terminal ends of the third and fourth wires, respectively, to third and fourth electrical contacts, respectively, of the electrical connector.

20. A method in accordance with claim 19, wherein the first, second, third, and fourth electrical contacts form an array of electrical contacts located at an output end of the electrical connector.

* * * * *